US005495643A

United States Patent [19]

Katori

[11] Patent Number: 5,495,643

[45] Date of Patent: Mar. 5, 1996

[54] METHOD AND APPARATUS FOR CONTROLLING THE ROCKING OF A NIPPER FRAME IN A LAP NIPPING MECHANISM FOR A COMBER

[75] Inventor: Mutsuhiko Katori, Nagoya, Japan

[73] Assignee: Kabushiki Kaisha Hara Shokki Seisakusho, Gifu, Japan

[21] Appl. No.: 362,543

[22] PCT Filed: Jun. 24, 1994

[86] PCT No.: PCT/JP94/01018

§ 371 Date: Jan. 4, 1995

§ 102(e) Date: Jan. 4, 1995

[87] PCT Pub. No.: WO95/03440

PCT Pub. Date: Feb. 2, 1995

[30] Foreign Application Priority Data

Jul. 21, 1993 [JP] Japan ..... 5-180472

[51] Int. Cl.[6] ..... D01G 19/16

[52] U.S. Cl. ..... 19/225; 19/215; 74/96; 74/106

[58] Field of Search ..... 19/215, 220, 223, 19/225; 74/96, 106

[56] References Cited

U.S. PATENT DOCUMENTS

| | | | |
|---|---|---|---|
| 1,401,179 | 12/1921 | Nasmith | 19/225 X |
| 1,516,101 | 11/1924 | Jolly | 19/225 X |
| 1,816,644 | 7/1931 | Gégauff | 19/225 X |
| 2,202,816 | 6/1940 | Nasmith | 19/225 |
| 3,184,799 | 5/1965 | Gauvain | 19/225 |
| 3,320,643 | 5/1967 | Katori | 19/225 |
| 3,479,699 | 11/1969 | Von Kaenel et al. | 19/223 |
| 3,600,758 | 8/1971 | Von Kaenel et al. | 19/225 |
| 4,295,249 | 10/1981 | Siemon | 19/225 |
| 4,672,717 | 6/1987 | Shimomura | 19/225 |

FOREIGN PATENT DOCUMENTS

| | | | |
|---|---|---|---|
| 0351371 | 12/1989 | European Pat. Off. . | |
| 675329 | 5/1929 | France . | |
| 1562179 | 4/1969 | France . | |
| 277922 | 4/1990 | German Dem. Rep. | 19/225 |
| 277921 | 4/1990 | German Dem. Rep. | 19/225 |
| 3933366 | 7/1990 | Germany | 19/225 |
| 38-10371 | 6/1961 | Japan . | |
| 50-98068 | 8/1975 | Japan . | |
| 54-11335 | 1/1979 | Japan . | |
| 55-80525 | 10/1979 | Japan . | |
| 357971 | 10/1984 | Japan . | |
| 60-224821 | 11/1985 | Japan . | |
| 2-112418 | 9/1989 | Japan . | |
| 3-174021 | 7/1991 | Japan . | |
| 106523 | 5/1922 | Switzerland | 19/116 |

*Primary Examiner*—John J. Calvert
*Attorney, Agent, or Firm*—Sheridan Ross & McIntosh

[57] ABSTRACT

A camless lap nipping mechanism for use in a comber is disclosed. A nipper frame (3) is provided above a combing cylinder (1). A cushion plate (4) is mounted on a distal end of the nipper frame (3). The cushion plate (4) nips a lap (Lp) in cooperation with a nipper member (7). Two stationary pivots (14,15) are provided, one above and one below the nipper frame (3). A four-node link mechanism, having two movable pivots (20,21) with a following lever (19) located therebetween, is provided between the stationary pivots (14,15). The front portion of the nipper frame (3) is pivotably linked to the following lever (19). A nipper shaft (11), and the four-node link mechanism (17,18,19) cooperate in rocking the nipper frame (3).

9 Claims, 6 Drawing Sheets

METHOD AND APPARATUS FOR CONTROLLING THE ROCKING OF A NIPPER FRAME IN A LAP NIPPING MECHANISM FOR A COMBER

BACKGROUND OF THE INVENTION

1. Field of the Invention

The present invention relates to a lap nipping mechanism in a comber which produces a thin sheet composed of fibers, so-called "fleece", by removing short fibers from a group of fibers, so-called "lap", in the manufacturing process of cotton yarn. In particular, the present invention relates to control of the rocking operation of a nipper frame in the lap nipping mechanism, the nipper frame having a cushion plate for use in nipping a lap.

2. Description of the Related Art

The average length of cotton fiber depends on its kind or its place of origin. Additionally, even in the same kind of cotton, its average fiber length is not constant and often varies. To produce high-grade cotton yarn with superior tenacity and appearance, it is necessary to remove short cotton fibers (including foreign matter such as nep). Use of a comber is an effective way to attain this objective.

Generally, a comber comprises a combing cylinder, a top comb, a pair of detaching rollers, and a nipper apparatus. The nipper apparatus rocks back and forth while nipping sheet-like fibers, so-called "lap", supplied thereto. The combing cylinder has a series of needles (i.e., cylinder needles) embedded on its peripheral surface (i.e., cylinder half lap). As the nipper apparatus moves backward (away from the detaching rollers), the needles comb the forward end of the lap. This action is called "combing". This combing action removes short fibers from the lap, producing a thin sheet-like fiber product, so-called "fleece".

The fleece is transferred forward as the nipper apparatus moves forward (towards the detaching rollers). As the newly combed fleece moves forward, the detaching rollers rotate in reverse and cause a preceding fleece, previously combed, to move rearward. As a result, the rear end of the preceding fleece is overlapped with the front end of a newly combed fleece (i.e., succeeding fleece). Then, the detaching rollers rotate in the forward direction of rotation, to pull out forward the pieced together fleeces. This action is called "piecing". During piecing process, the top comb combs the rear end of the succeeding fleece. In the combing process, these operations are repeated to effectively remove the short cotton fibers from the lap.

In general, the nipper apparatus comprises a nipper frame, a cushion plate fixed on the nipper frame at its front end, and a nipper knife to nip the lap in cooperation with the cushion plate. The nipper knife nips the lap at the tip of the cushion plate. The nipper frame can rock between a backmost position where the tip of the cushion plate is proximate to the cylinder needles and a foremost position where the tip is proximate to the detaching rollers.

Methods of rocking the nipper frame in a comber are roughly classified into the following three types according to a path drawn by the tip of the cushion plate.

(Type 1): A nipper frame is rockably supported by a rocking mechanism located above it. The tip of the cushion plate moves along a downward projecting arc, which is part of a circle adjacent to a circle drawn by the tips of cylinder needles when the combing cylinder runs. The circle drawn by the tips of the cylinder needles is hereinafter referred to as "cylinder circle".

(Type 2): A nipper frame is driven by a nipper shaft located below the frame, and is supported in a rockable manner by a four-node link mechanism with the nipper shaft as a stationary point in the link. As the nipper frame rocks, the tip of the cushion plate moves along an upward projecting arc, which is part of a circle encompassing the cylinder circle.

(Type 3): A nipper frame is designed so that the tip of the cushion plate moves along a substantially straight horizontal line, which is a path tangent to the cylinder circle.

In a type 1 apparatus, when the cushion plate moves, a section in which its tip approaches the cylinder circle is short. This results in insufficient combing. In a type 2 apparatus, the section in which the tip of the cushion plate approaches the cylinder circle is longer in comparison with the type 1 apparatus. This results in good combing. However, when the tip of the cushion plate reaches the foremost position in the rocking stroke, the tip is located below a position where a pair of upper and lower detaching rollers nip a succeeding fleece. Consequently, the front end of the succeeding fleece is likely to bend during piecing process. This may prevent smooth piecing. In addition, the rocking stroke of the nipper frame in the type 2 apparatus is greater than that in the type 1 apparatus, and hence the type 2 apparatus tends to generate vibrations during high-speed machine operation.

The type 3 apparatus is a compromise between the type 1 and 2 apparatuses. This design, however, caused insufficient combing and piecing operations. According to the type 3 design, the tip of the cushion plate approaches the cylinder needles at a position just over the cylinder circle. This increases the rocking stroke of the nipper frame.

In order to solve these problems, Japanese Unexamined Patent Publication No. 54-6926 discloses a method for controlling the rocking of the nipper frame as described below. In a total path along which the tip of the cushion plate together with the nipper frame rocks, there exists a point where the cushion plate tip nips a lap in cooperation with the nipper knife and releases the lap. The nip/release point is hereinafter referred to as "nipper opening/closing position". Its total path is divided into two sections: a front section between the foremost position and the nipper opening/closing position; and a rear section between the nipper opening/closing position and the backmost position.

In the rear section, the cushion plate tip moves along an upward projecting arc path in proximity to the cylinder circle. In the front section, the cushion plate tip moves upward along an inclined path coupled to the front end of the arc path in the rear section.

Specifically, a nipper frame 32 is rocked by a four-node link mechanism comprising a rocking lever 31, the nipper frame 32 and a following lever 33, as shown in FIGS. 5 and 6. During the rocking motion, a pivot 34 of the following lever 33, connected to the front portion of the nipper frame 32 is displaced. The following lever 33 is in a two-link structure comprising a first link 35 and a second link 36. The second link 36, forming the base portion of the following lever 33, is pressed against a stopper 38 by the action of a spring 37. When the tip of a cushion plate 40 is disposed in the front section, the first link 35 forming the distal end portion of the following lever 33 is able to pivot about a pivot **36*a*, while the first link 35 is integrated with the second link 36**.

As shown in FIG. 5, when the tip of the cushion plate 40 is disposed in the rear section, the second link 36 does not pivot, but the first link 35 rocks about a pivot 35*a*. This rocking motion causes the tip of the cushion plate 40 to move along an upward projecting arc in proximity to a cylinder circle 41 as defined above.

As shown in FIG. 6, when the tip of the cushion plate 40 is disposed in the front section, the first and second links 35 and 36 pivot together as a unit about the pivot 36*a*. This pivoting motion causes the tip of the cushion plate 40 to move upward along an inclined path connecting the front point of the upward projecting arc path and a "nip position" where detaching rollers 39 nip a succeeding fleece therebetween. In this conventional method, however, the second link 36 supporting the nipper frame 32 repeatedly comes in contact with and moves away from the stopper 38, as the nipper frame 32 rocks. This repetitive action causes the second link 36 and the stopper 38 to wear off and generates noise and vibration. The noise and vibrations become more remarkable as the machine runs at higher speeds. Also, when lint is caught between the second link and the stopper, the nipper frame 32 cannot rock along the predetermined path.

According to a method of controlling nipper frame rocking disclosed in Japanese Unexamined Patent Publication No. 54-11335, when the cushion plate tip is disposed in the rear section, the cushion plate tip reciprocates along a path similar to the path disclosed in Japanese Unexamined Patent Publication No. 54-6926, as the nipper frame rocks. The cushion plate tip performs its cyclic motion along a predetermined path in the front section, so that the cushion plate tip goes upward along an inclined path toward the foremost position from the nipper opening/closing position, turns to the horizontal or downward direction to approach the nip position, and then returns downward along an inclined path to the nipper opening/closing position.

Specifically, as shown in FIGS. 7 and 8, a nipper apparatus used in this method comprises a four-node link mechanism made up of a rocking lever 31, a nipper frame 32, a following lever 43, and a rocking arm 44. The following lever 43 has a first end (upper end) linked to the nipper frame 32 at its forward portion, and a second end (lower end) linked to the rocking arm 44. The rocking arm 44 rocks up and down through a cam 46 fixed on a cylinder shaft 45. As the rocking arm 44 rocks, a pivot 43*a* is displaced up and down, and the tip of the cushion plate 40 rocks along the aforementioned predetermined path.

This nipper apparatus, however, not only requires lubrication for maintenance but also has a disadvantage in that lint is apt to be caught between the cam 46 and a cam roller 47 of the rocking arm 44. If lint is caught, the nipper frame 32 is prevented from rocking along a predetermined path. Also, using the cam 46 requires troublesome adjustments and its screws tend to loosen.

SUMMARY OF THE INVENTION

It is an object of the present invention to provide a lap nipping mechanism for a comber without using a cam mechanism. This will prevent noise and vibrations from being generated and foreign matter such as lint from being caught and will speed-up the machine.

To solve the aforementioned and other problems in accordance with the object of the present invention, there is provided an improved lap nipping mechanism for a comber. The nipping mechanism comprises a pair of detaching rollers, a combing cylinder for combing a lap supplied thereto to make a succeeding fleece, and a top comber for combing the rear end of the succeeding fleece. When a preceding fleece nipped between the pair of detaching rollers is fed forward, the succeeding fleece is pieced to the preceding fleece.

The nipping mechanism according to the present invention includes a nipper frame, located above the combing cylinder, to be rocked back and forth. A cushion plate is attached to the tip of the nipper frame. In accordance with the rocking of the nipper frame, the cushion plate nips a lap in cooperation with a nipper member. The front end of a driving arm is pivotably linked to the nipper frame at its rear end portion. The base end of the driving arm is fixed on a nipper shaft that is rotatable in forward and reverse rotational directions. The nipper shaft is disposed behind the combing cylinder and below the nipper frame. Two stationary pivots are located above and below the nipper frame, respectively. A four-node link mechanism is provided between the two stationary pivots, and has two movable pivots between which a following lever is located as a connector. The upper stationary pivot is located behind the lower stationary pivot. The front portion of the nipper frame is pivotably linked to the following lever. The nipper shaft, the driving arm and the four-link mechanism cooperate in rocking the nipper frame.

As the nipper frame rocks, the tip of the cushion plate moves along an upward projecting arc in a path section where the cushion plate tip is in the proximity of the combing cylinder. In this case, the cushion plate tip moves while maintaining a constant clearance between the tip and the cylinder circle. This lengthens the time of combing the lap to implement effective combing.

The cushion plate tip moves along a downward projecting arc in the path section between the foremost position of the rocking stroke and a position where the cushion plate tip is in close proximity to the combing cylinder. Hence, the cushion plate tip reaches a height at which the detaching rollers nip the fleece. Accordingly, the front end portion of the succeeding fleece will not bend when the preceding and succeeding fleeces are pieced together. This implements good piecing action.

Moreover, since the drive mechanism of the nipper frame does not employ a conventional multistage link using a cam mechanism or a stopper therewith. Consequently, the generation of noise and vibrations can be suppressed, and the catching of lint can be prevented. This makes it possible to obtain a comber suitable for a high-speed machine.

DESCRIPTION OF THE PREFERRED EMBODIMENT

An embodiment of the present invention will be described with reference to the drawings.

Figure 1:
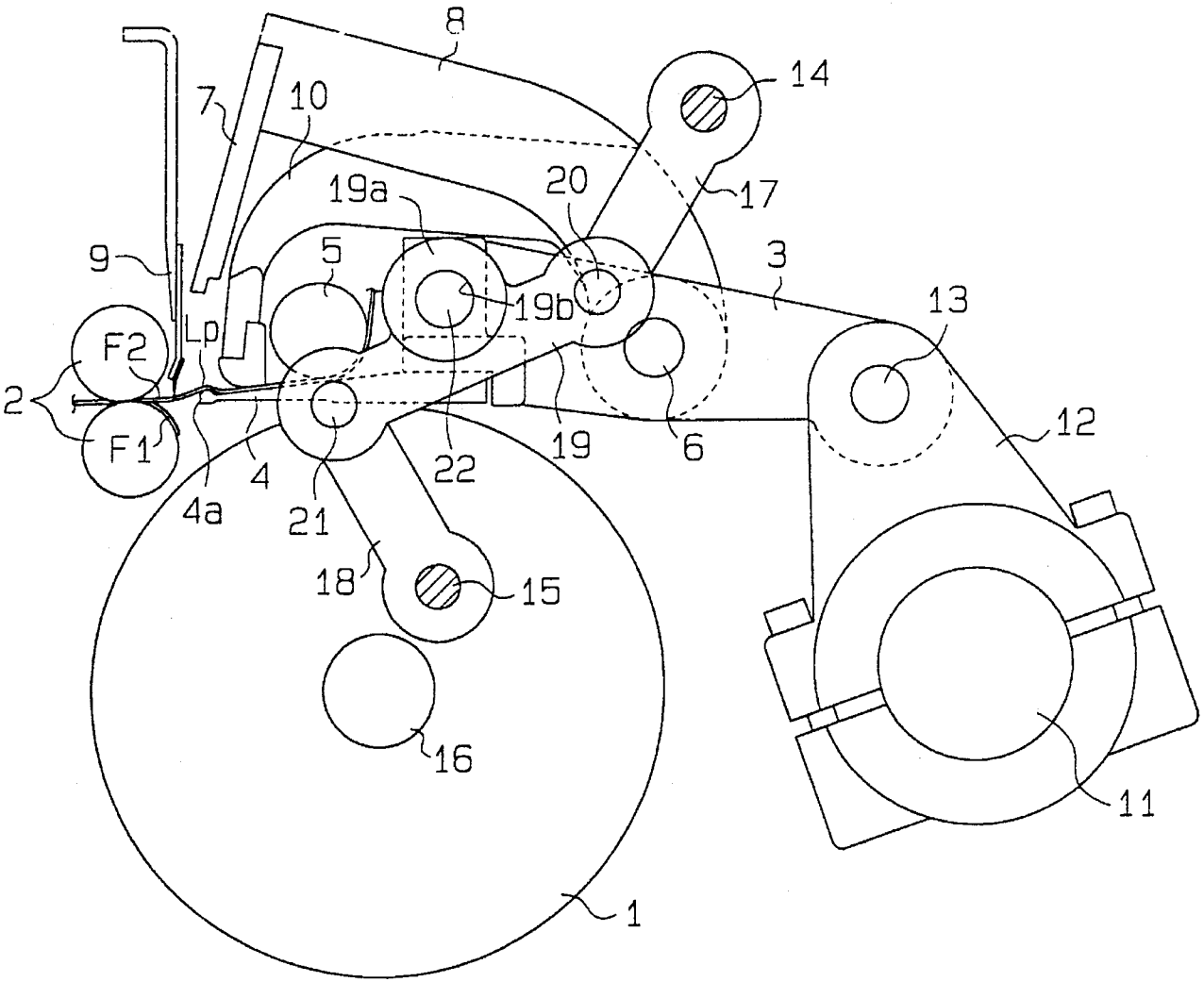
FIG. 1 is a side view showing the state of a nipper frame when it is brought in the foremost position of its rocking stroke by a lap nipping mechanism according to the present invention.
Figure 2:
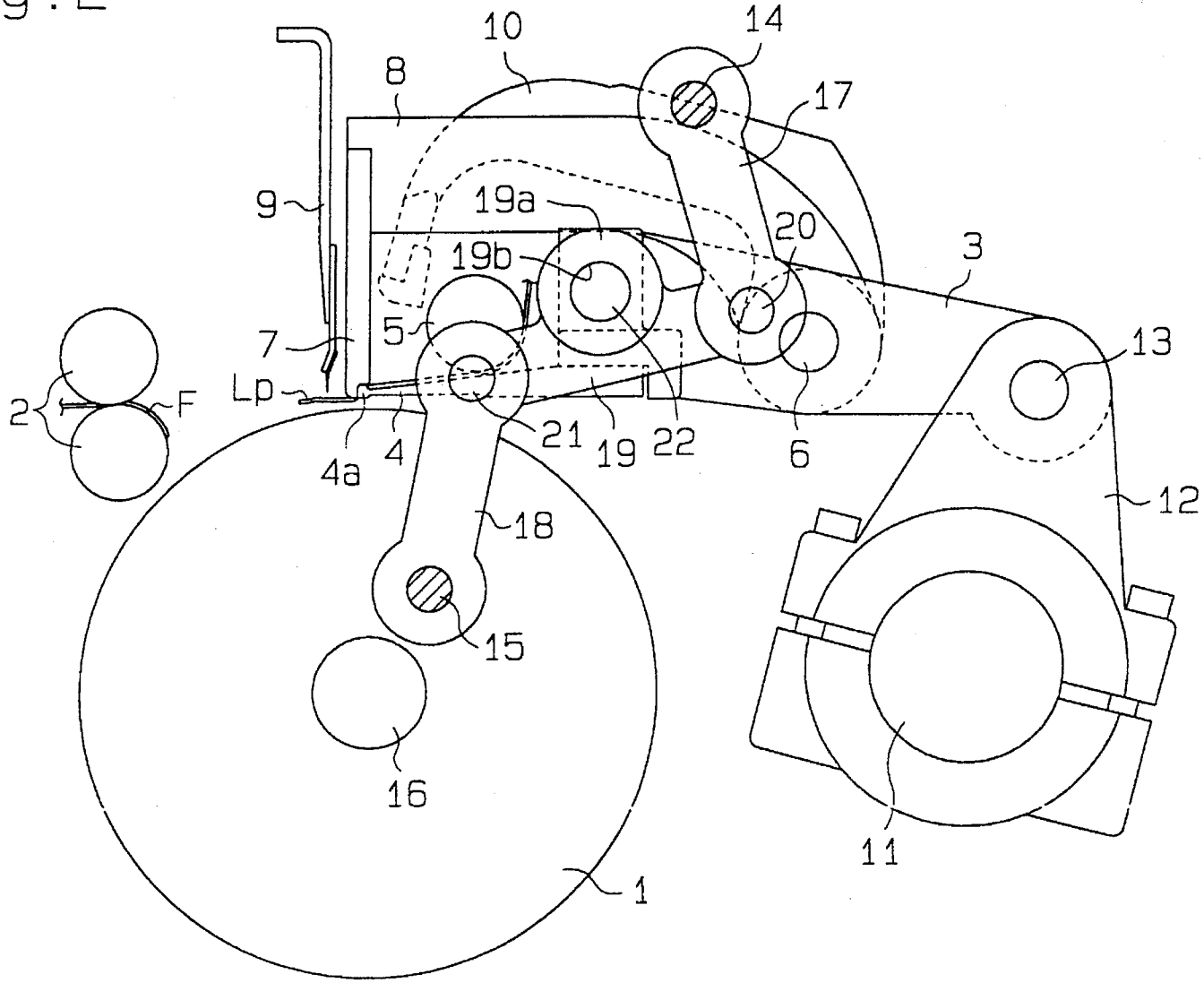
FIG. 2 is a side view showing the state of the nipper frame when it is brought in the backmost position of its rocking stroke.

As shown in FIGS. 1 and 2, a pair of detaching rollers 2 are disposed to be adjacent in a vertical direction at the upper front of a combing cylinder 1. The detaching rollers 2 feed fleeces F1 and F2 forward and backward. A nipper frame 3 is provided above the combing cylinder 1. A cushion plate 4 is fixed on the nipper frame 3 at the front end portion thereof. A feed roller 5 is rotatably provided above the cushion plate 4. A lap feeding source (not illustrated) feeds a lap Lp between the feed roller 5 and the cushion plate 4. As a result of an intermittent rotation of the feed roller 5, the lap Lp required for one cycle of combing is fed near the tip 4*a* of the cushion plate 4. A nipper arm pin 6 is attached to the nipper frame 3 at a center portion thereof, and a nipper arm 8 is pivotably supported on the nipper arm pin 6. A nipper knife 7 is fixed on the nipper arm 8 at a forward end thereof. The nipper 7 is moved up and down by means of a well-known mechanism (not illustrated), at a predetermined timing in synchronism with the forward and backward rocking motion of the nipper frame 3. A top comb 9 is fixed ahead of the cushion plate 4 by an unillustrated mechanism. The top comb 9 carries out a predetermined motion in synchronism with the nipper frame 3.

A pressure plate nipper 10 is pivotably supported on the nipper arm pin 6. The pressure plate nipper 10 is operated by means of a well-known drive mechanism (not shown) at a predetermined timing, in accordance with the rocking of the nipper frame 3, to nip the lap by pressing it against the cushion plate 4 when the rear end portion of the combed lap is being combed by the top comb 9.

On a machine frame (not shown), a drive shaft 11 is provided behind the combing cylinder 1 and below the nipper frame 3, such that the drive shaft 11 is pivotable in a forward and reverse directions. The base end of a nipper frame driving arm 12 is fixed on the drive shaft 11 to allow the joint pivoting of the nipper shaft and the nipper frame driving arm. A pivot 13 is fixed on the distal end of the arm 12. The rear end portion of the nipper frame 3 is pivotably supported on the pivot 13.

Pivots 14 and 15, as stationary pivots of a four-node link mechanism, are provided above and below the nipper frame 3, respectively, on the machine frame (not shown) and beside the nipper frame 3. The pivots 14 and 15 are in parallel with the pivot 13. The lower pivot 15 is located above a cylinder shaft 16. The upper pivot 14 is located to the rear of the lower pivot 15, and ahead of the position of the pivot 13 when the nipper frame 3 is in its foremost position of its rocking stroke, as shown in FIG. 1. First ends (i.e., proximal ends) of the first and second rocking levers 17 and 18 are pivotably supported on the pivots 14 and 15, respectively. Second ends (i.e., distal ends) of the rocking levers 17 and 18 are linked to both ends of a following lever 19 through movable pivots 20 and 21. The rocking levers 17 and 18, the following lever 19 as a connector, the stationary pivots 14 and 15, and the movable pivots 20 and 21 form the four-node link mechanism.

A boss 19*a* is formed on the following lever 19 at an upper center portion thereof, while a hole 19*b* is formed in the boss 19*a*. The nipper frame 3 is pivotably connected to the following lever 19 via a connecting shaft 22 which fits into the hole 19*b* and into another hole (not shown) formed in the front end portion of the nipper frame 3.

The distance between the stationary pivot 14 and the movable pivot 20 in the rocking lever 17 is equal to the distance between the stationary pivot 15 and the movable pivot 21 in the rocking lever 18. When the first rocking lever 17 rocks, its second end describes a downward projecting arc (hereinafter referred to as "downward convex arc") beside the nipper frame 3. When the second rocking lever 18 rocks, its second end describes an upward projecting arc (hereinafter referred to as "upward convex arc") beside the cushion plate 4.

Figure 3:
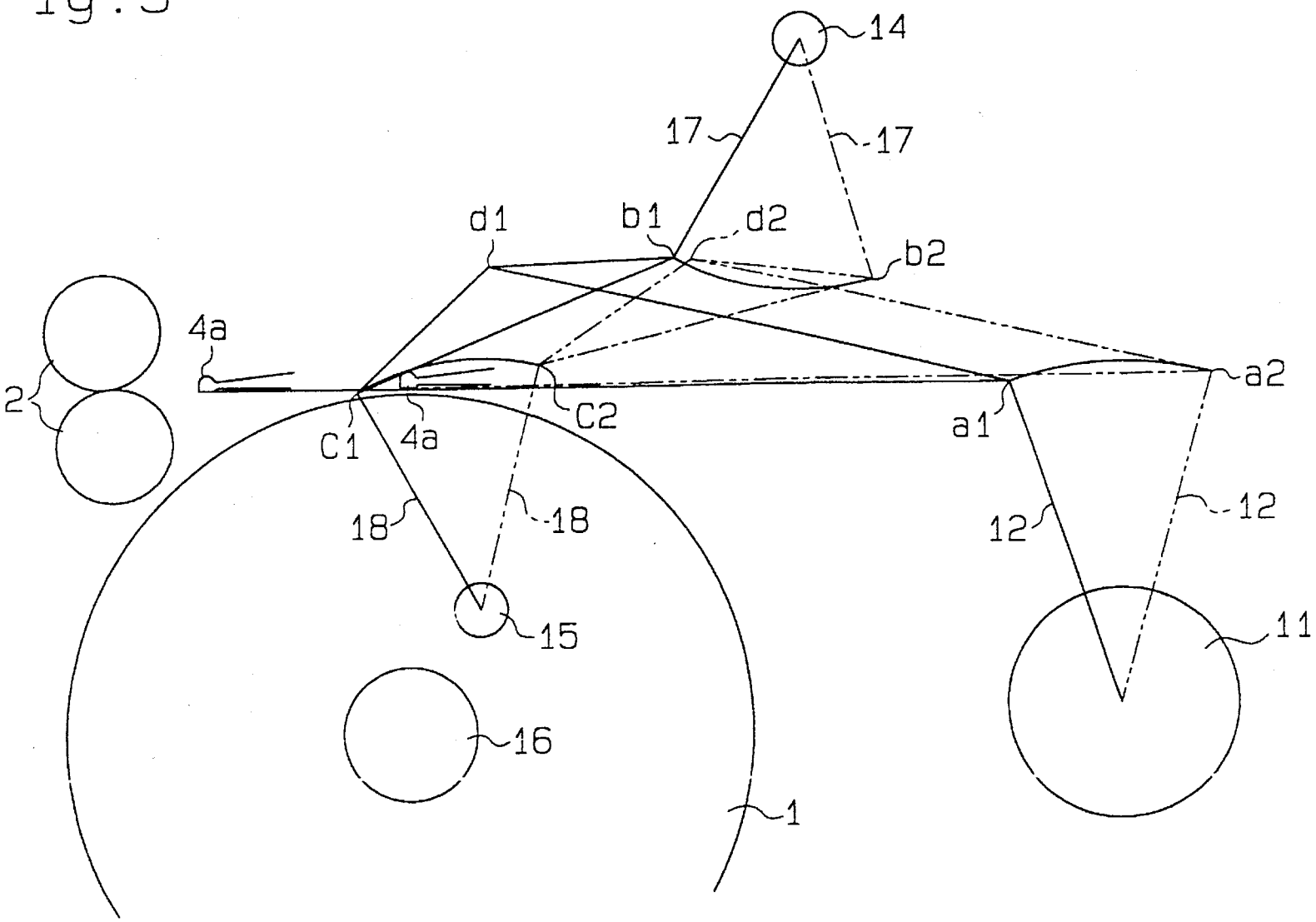
FIG. 3 is an illustration showing actions of a nipper frame rocking apparatus.

When the drive shaft 11 pivots in the forward and reverse directions, the arm 12 rocks with respect to the drive shaft 11, while the pivot 13, located at the distal end of the arm 12, moves along an upward convex arc (a1–a2) as shown in FIG. 3.

Figure 4:
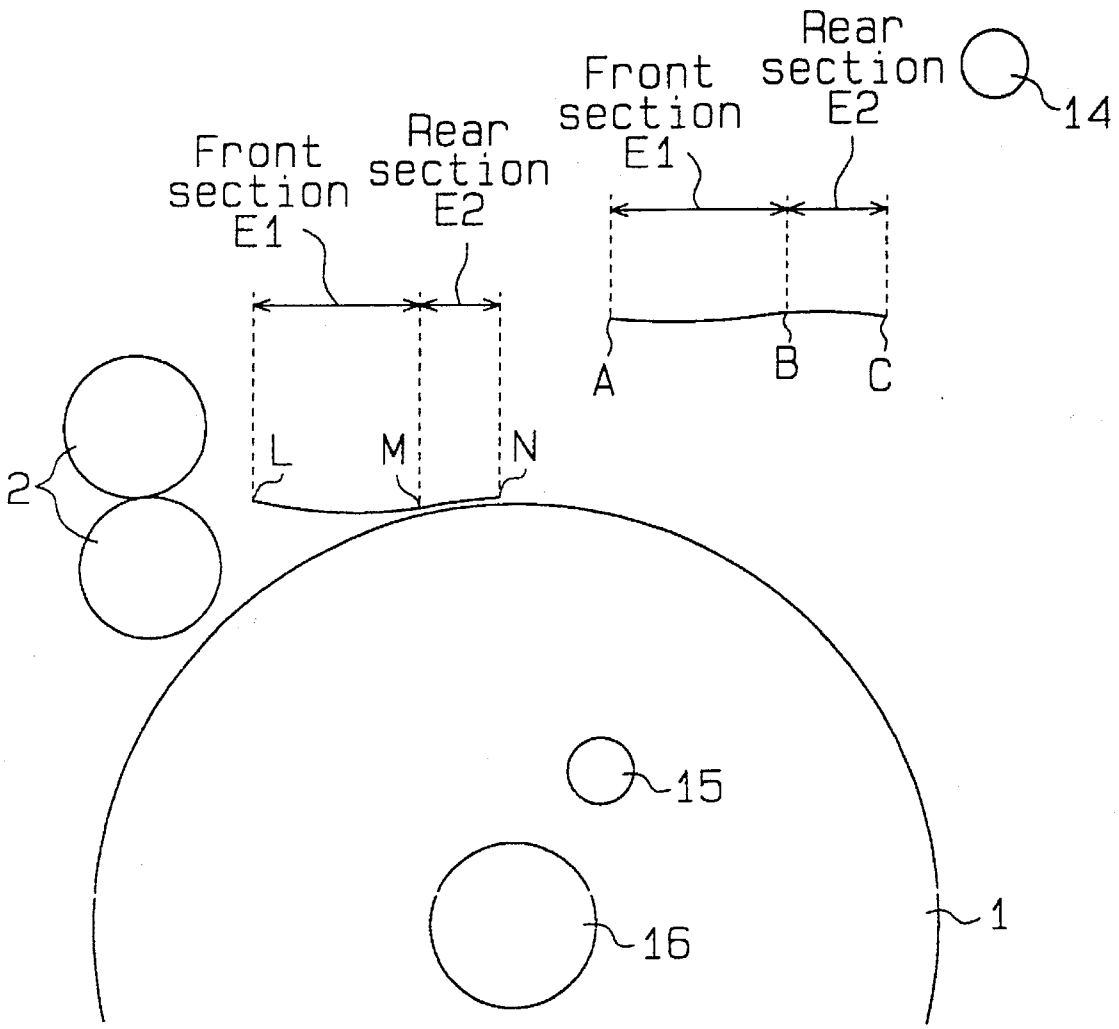
FIG. 4 is a schematic illustration showing both a rocking path of a rockable pivot of a following lever and a rocking path of a nipper end.
Figure 5:
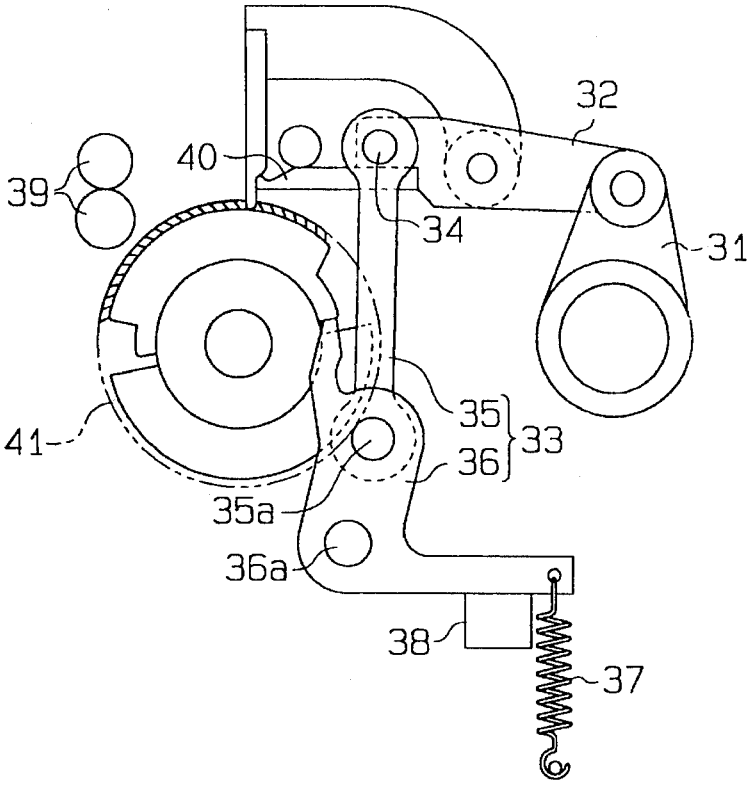
Fig.5 (Prior Art)
FIG. 5 is a side view showing the state of a nipper frame according to the prior art when it is brought in the backmost position of its rocking stroke.
Figure 6:
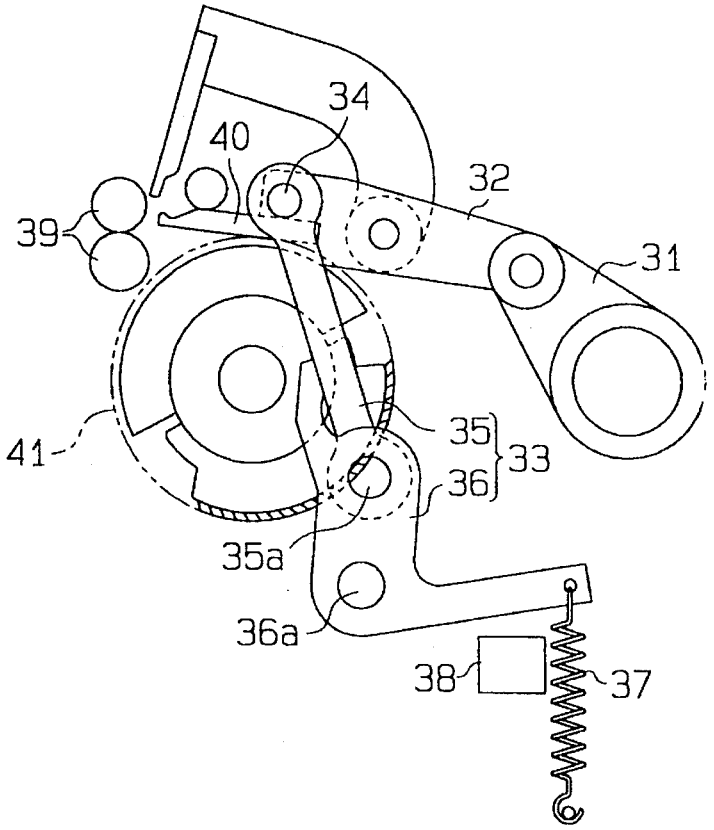
Fig.6 (Prior Art)
FIG. 6 is a side view showing the state of the nipper frame shown in FIG. 5 when it is brought in the foremost position of its rocking stroke.
Figure 7:
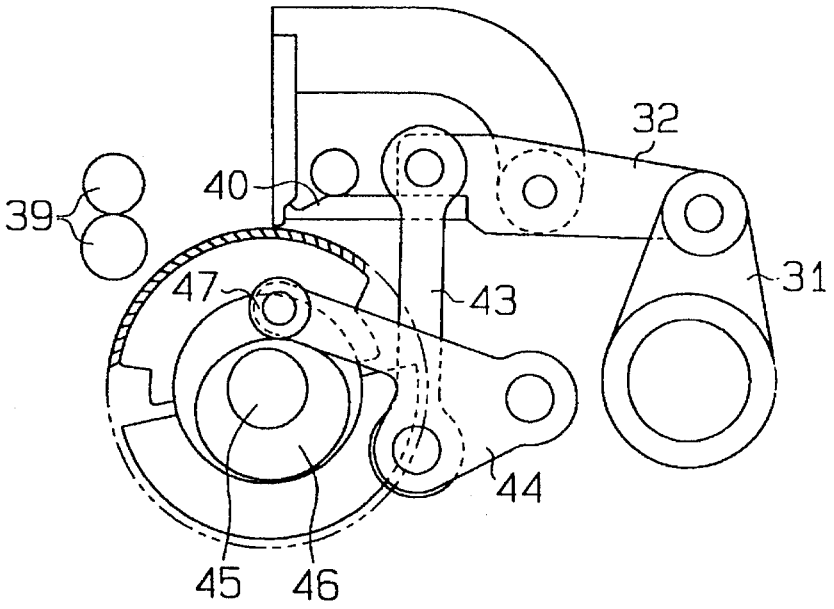
Fig.7 (Prior Art)
FIG. 7 is a side view showing the state of an another nipper frame according to the prior art when it is brought in the backmost position of its rocking stroke.
Figure 8:
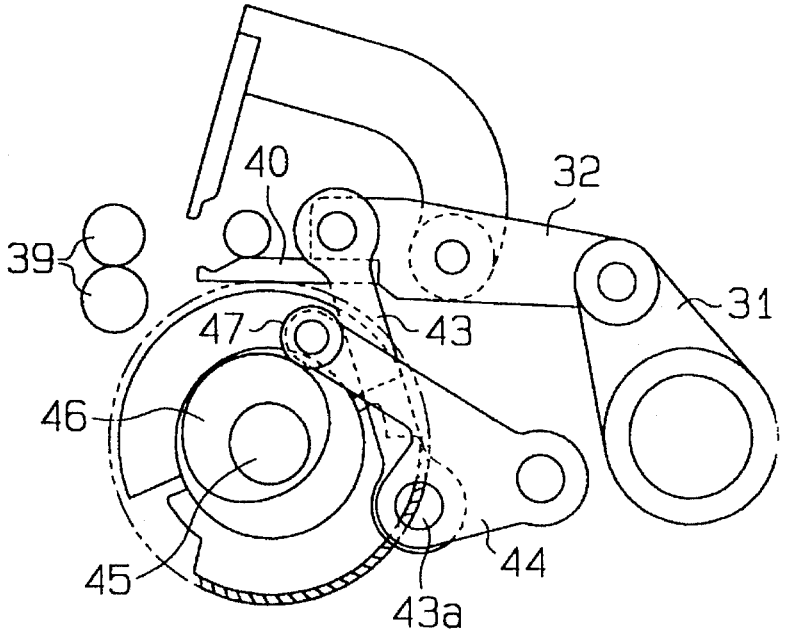
Fig.8 (Prior Art)
FIG. 8 is a side view showing the state of the nipper frame shown in FIG. 7 when it is brought in the foremost position of its rocking stroke.

When the pivot 13 moves along the arc (a1–a2), the distal end of the first rocking lever 17 supported on the stationary pivot 14 moves along a downward convex arc (b1–b2) as shown in FIG. 3, while the distal end of the second rocking lever 18 supported on the stationary pivot 15 moves along an upward convex (c1–c2). As the nipper frame 3 moves backward from the foremost position of its rocking stroke as shown in FIG. 1, the connecting shaft 22 on the following lever 19 moves along a flat S-shaped smooth curve (A-B-C) as shown in FIG. 4. Also, as the nipper frame 3 moves backward, the tip 4*a* of the cushion plate 4 fixed on the nipper frame 3 (the tip 4*a* is hereinafter referred to as the "nipper end") moves along a smooth curve (L-M-N) as shown in FIG. 4.

In FIG. 4, position M indicates a position of the nipper end 4*a* where the nipper end 4*a* nips and releases the lap Lp in cooperation with the nipper knife 7, i.e., a nipper opening/closing position. Position N indicates the backmost position of a rocking stroke of the nipper end 4*a*, while position L indicates the foremost position of a rocking stroke of the nipper end 4*a*. In more detail, the nipper end 4*a* reciprocates across a section between position N and position L. In a rear section E2, i.e., a section between positions M and N in the total reciprocating path, the lap Lp is nipped between the nipper knife 7 and the nipper end 4*a* and undergoes combing by needle segments (not shown) of the combing cylinder 1. When the connecting shaft 22 is in its rear section E2, the shaft 22 moves along an upward convex arc. When the nipper end 4*a* is in the rear section E2, the nipper end 4*a* describes an upward convex arc along a cylinder circle.

The nipper frame 3 reaches the backmost position of its rocking stroke, and thereafter resumes moving forward. As the connecting shaft 22 moves from position C toward position B, the nipper end 4*a* moves forward from the backmost position N to the position M. During this movement, the nipper end 4*a* also describes an upward convex arc (N-M) along the cylinder circle in the same manner as mentioned above. Combing is also carried out while the nipper end 4*a* moves from position N to position M. In other words, when the nipper end 4*a* rocks backward toward the backmost position N and also when the nipper end rocks forward from the backmost position N toward position M, the nipper end is in close proximity to the cylinder circle and moves along an upward convex arc in parallel with the cylinder circle. Accordingly, while the lap Lp undergoes combing, the nipper end 4a moves maintaining a certain clearance between the nipper end and the cylinder circle. This lengthens the time of combing the lap Lp to allow for effective combing.

When the connecting shaft 22 moves across the front section E1, the shaft describes a downward convex arc, and the nipper end 4a describes a downward convex arc (M-L). When the nipper end 4a reaches the foremost position of its rocking stroke, the nipper end is located at a height suitable for piecing, i.e., substantially as high as a nip point of the upper and lower detaching rollers 2. Accordingly, when the preceding fleece F1 and the succeeding fleece F2 are pieced together, the forward end portion of the succeeding fleece F2 is prevented from bending. This results in implementing good piecing together of the fleeces.

Since the nipper end 4a moves along the aforementioned curve (L-M-N), a rocking range of the nipper frame 3 is smaller in comparison with the conventional art (type 3) wherein the nipper frame is rocked such that the nipper end 4a moves along a tangent to the combing cylinder 1. Also, since the nipper frame 3 according to this embodiment employs only a link mechanism without using a cam mechanism, lint and other foreign matter is unlikely to be caught between mechanism members. Moreover, since the nipper frame rocking mechanism according to the present invention does not employ a conventional multistage link using a stopper therewith, the generation of noise and vibrations is suppressed. This makes it possible to obtain a comber suitable for a high-speed machine.

Although only one embodiment of the present invention has been described herein, it should be apparent to those skilled in the art that the present invention may be embodied in many other specific forms without departing from the spirit or scope of the invention. Particularly, it should be understood that the present invention may be embodied in the following form.

The first and second rocking levers 17 and 18 constituting the four-node link may have different length from each other. The length of the following lever 19 may be changed. The position of the stationary pivots 14 and 15 may be changed. The position of the connecting shaft 22 on the following lever 19 may be changed. A plurality of driving arms 12 may be fixed on one drive shaft 11, and the nipper frame 3 may be pivotably linked to each driving arm 12 for rocking. Also, the present invention may be applied to a comber having no pressure plate nipper 10.

The present embodiment is to be considered as illustrative and not restrictive and the invention is not to be limited to the details given herein, but may be modified within the scope of the appended claims.

I claim:

1. A method of controlling the rocking of a nipper frame in a comber which comprises:

a pair of detaching rollers for feeding a fleece forward and backward;

a combing cylinder for combing a lap supplied thereto to produce a succeeding fleece;

a top comb for combing the rear end of said succeeding fleece;

a nipper frame, disposed above said combing cylinder, to be rocked forward and backward;

a cushion plate mounted on said nipper frame at a distal end portion thereof;

a nipper member which repeatedly approaches and moves away from said cushion plate in response to the rocking of said nipper frame, and which nips the lap in cooperation with said cushion plate;

a nipper shaft pivotable in forward and reverse directions;

a driving arm which is fixed on said nipper shaft and whose distal end is pivotably linked to said nipper frame at its rear end; and a four-node link mechanism having two stationary pivots and two movable pivots with a connector located therebetween, said connector and the front portion of said nipper frame being pivotably linked together, wherein said nipper frame and said cushion plate rock in a predetermined rocking section in response to the driving action of said nipper shaft and said driving arm, said method comprising the steps of:

rocking said nipper frame such that the tip of said cushion plate moves along an upward projecting arc in a rear section of said predetermined rocking section where the tip of said cushion plate moves in proximity to said combing cylinder while nipping the lap in cooperation with said nipper member; and rocking said nipper frame such that the tip of said cushion plate moves along a downward projecting arc in a front section of said predetermined rocking section where the tip of said cushion plate approaches said pair of detaching roller with releasing the lap which was nipped in cooperation with said nipper member.

2. A lap nipping mechanism for a comber which comprises a pair of detaching rollers for feeding a fleece forward and backward, a combing cylinder for combing a supplied lap to make a succeeding fleece, and a top comb for combing the rear end portion of said succeeding fleece, wherein the comber pieces together a preceding fleece and said succeeding fleece when the preceding fleece nipped between said pair of detaching rollers is fed forward, said mechanism comprising:

a nipper frame, disposed above said combing cylinder, to be rocked forward and backward;

a cushion plate mounted on said nipper frame at a distal end portion thereof;

a nipper member which repeatedly approaches and moves away from said cushion plate, in response to the rocking action of said nipper frame, and which nips the lap in cooperation with said cushion plate;

a nipper shaft disposed behind said combing cylinder and below said nipper frame, and being pivotable in forward and reverse directions;

a driving arm which is fixed on said nipper shaft and whose distal end is pivotably linked to said nipper frame at a rear end portion thereof; and a four-node link mechanism having two stationary pivots disposed above and below said nipper frame, respectively, and two movable pivots with a following lever located therebetween as a connector, wherein said upper stationary pivot is located behind said lower stationary pivot, the front portion of said nipper frame is pivotably linked to said following lever, and whereby said nipper shaft, said driving arm and said four-node link mechanism cooperate in rocking said nipper frame.

3. The lap nipping mechanism for a comber according to claim 2, wherein said upper stationary pivot is located ahead of a pivot linking together the rear end of said nipper frame and said driving arm when the tip of said cushion plate is in proximity to said pair of detaching rollers, and said lower stationary pivot is located above a cylinder shaft of said combing cylinder.

4. The lap nipping mechanism for a comber according to claim 2, wherein said nipper frame is pivotably linked to said following lever at a substantially central portion thereof.

5. The lap nipping mechanism for a comber according to claim 2, wherein said four-node link mechanism comprises a first rocking lever pivotably linked to said upper stationary pivot and a second rocking lever pivotably linked to said lower stationary pivot.

6. The lap nipping mechanism for a comber according to claim 5, wherein the distance between said upper stationary pivot and said movable pivot in said first rocking lever is equal to the distance between said lower stationary pivot and said movable pivot in said second rocking lever.

7. The lap nipping mechanism for a comber according to claim 6, wherein as said first rocking lever rocks, its end on the side of its said movable pivot moves along a downward projecting arc beside said nipper frame; and wherein as said second rocking lever rocks, its end on the side of its said movable pivot moves along an upward projecting arc beside said cushion plate.

8. The lap nipping mechanism for a comber according to claim 2, wherein said nipper member is fixed on the forward end of a nipper arm pivotably linked to said nipper frame.

9. The lap nipping mechanism for a comber according to claim 8, wherein a pressure plate nipper which nips the lap in such a manner as to press it against said cushion plate, is pivotably linked to said nipper frame.

* * * * *